US009293847B2

(12) United States Patent
Yokoyama et al.

(10) Patent No.: US 9,293,847 B2
(45) Date of Patent: Mar. 22, 2016

(54) CONNECTOR HAVING A HOLDING MEMBER WITH GUIDE PORTIONS WITH PROJECTIONS

(71) Applicants: JAPAN AVIATION ELECTRONICS INDUSTRY, LIMITED, Shibuya-ku, Tokyo (JP); SUMITOMO ELECTRIC INDUSTRIES, LTD., Osaka-shi, Osaka (JP)

(72) Inventors: Yohei Yokoyama, Tokyo (JP); Wataru Sakurai, Tokyo (JP); Toru Nakanishi, Tokyo (JP); Takayuki Shimazu, Tokyo (JP)

(73) Assignees: JAPAN AVIATION ELECTRONICS INDUSTRY, LIMITED, Tokyo (JP); SUMITOMO ELECTRIC INDUSTRIES, LTD, Osaka-Shi, Osaka (JP)

( * ) Notice: Subject to any disclaimer, the term of this patent is extended or adjusted under 35 U.S.C. 154(b) by 0 days.

(21) Appl. No.: 14/576,114

(22) Filed: Dec. 18, 2014

(65) Prior Publication Data

US 2015/0214646 A1 Jul. 30, 2015

(30) Foreign Application Priority Data

Jan. 28, 2014 (JP) ..... 2014-013569

(51) Int. Cl.

| | |
|---|---|
| ***H01R 13/64*** | (2006.01) |
| ***H01R 12/72*** | (2011.01) |
| ***H01R 12/70*** | (2011.01) |
| ***H01R 13/629*** | (2006.01) |

(52) U.S. Cl.

CPC ..... *H01R 12/721* (2013.01); *H01R 12/7005* (2013.01); *H01R 12/724* (2013.01); *H01R 13/629* (2013.01)

(58) Field of Classification Search

CPC ..... H01R 12/72; H01R 12/721; H01R 12/70; H01R 12/7005; H01R 12/7023; H01R 12/7029; H01R 13/64

USPC ..... 439/374, 377, 378, 629, 630, 680

See application file for complete search history.

(56) References Cited

U.S. PATENT DOCUMENTS

| | | | | |
|---|---|---|---|---|
| 6,350,143 | B2 * | 2/2002 | Kato | 439/297 |
| 6,361,350 | B2 * | 3/2002 | Johnson | 439/374 |
| 2012/0258633 | A1 * | 10/2012 | Johnson | H01R 13/405 439/660 |

(Continued)

FOREIGN PATENT DOCUMENTS

| | | | |
|---|---|---|---|
| JP | 05174910 | A | 7/1993 |
| JP | 2003085524 | A | 3/2003 |
| JP | 2013093433 | A | 5/2013 |

*Primary Examiner* — Chandrika Prasad

(74) *Attorney, Agent, or Firm* — Holtz, Holtz & Volek PC

(57) ABSTRACT

A connector includes a holding member. The holding member has two guide portions which are arranged away from each other in a pitch direction. Each of the guide portions has a side portion, an upper portion and a lower portion which are formed as described below. The side portion intersects with the pitch direction and is provided with a first projection portion and a side surface facing inward in the pitch direction. Each of the upper portion and the lower portion intersects with an up-down direction, and at least one of the upper portion and the lower portion is provided with a second projection portion. The first projection portion is away from both the upper portion and the lower portion and projects inward in the pitch direction from the side surface. The second projection portion is away from the side surface and projects inward in the up-down direction.

10 Claims, 10 Drawing Sheets

(56) References Cited

U.S. PATENT DOCUMENTS

2013/0040485 A1* 2/2013 Ngo ..... H01R 13/6273 439/350
2014/0030927 A1* 1/2014 Chen ..... H01R 23/68 439/629
2014/0220812 A1* 8/2014 Sasada ..... G06K 7/003 439/377
2015/0214645 A1* 7/2015 Yokoyama ..... H01R 12/7005 439/630

* cited by examiner

CONNECTOR HAVING A HOLDING MEMBER WITH GUIDE PORTIONS WITH PROJECTIONS

CROSS REFERENCE TO RELATED APPLICATIONS

An applicant claims priority under 35 U.S.C. §119 of Japanese Patent Application No. JP2014-013569 filed Jan. 28, 2014.

BACKGROUND OF THE INVENTION

This invention relates to a connector which is to be connected to a rigid circuit board.

For example, Patent Document 1 discloses a connector of this type. As shown in FIGS. 18 and 19, the connector 900 of Patent Document 1 is a card edge connector which is to be connected to a circuit board 950. The connector 900 comprises a plurality of contacts 920 and a holding member 910 holding the contacts 920. The circuit board 950 has a plurality of conductive pads 960 formed in the vicinity of an end 952 thereof.

Since the connector 900 of Patent Document 1 is a card edge connector, each of the connector 900 and the circuit board 950 has a size which is sufficiently large in comparison with manufacturing tolerances for the circuit board 950. In general, such a card edge connector is designed to have an inner size with allowance in consideration of manufacturing tolerances for a circuit board. Accordingly, there is no problem even if the circuit board is moved in the general card edge connector within the manufacturing tolerances for the card edge connector upon the connection of the general card edge connector with the circuit board.

However, there is a case where a relay board, or a kind of the circuit board, is used to connect between contacts arranged with small pitches and cable conductors, respectively. In this case, since it is difficult to make manufacturing tolerances for the relay board smaller, positioning of the relay board in a connector should be performed with careful consideration of the manufacturing tolerances for the relay board.

Patent Document 1: JP A 2013-93433, FIG. 5 (prior art in Patent Document 1)

SUMMARY OF THE INVENTION

It is therefore an object of the present invention to provide a connector which can improve positioning accuracy of a circuit board in the connector while considering manufacturing tolerances for the circuit board.

One aspect of the present invention provides a connector which has a rear end in a front-rear direction and is connected with a circuit board when the circuit board is inserted into the connector through the rear end along the front-rear direction. The connector comprises a plurality of contacts and a holding member holding the contacts. The holding member has a first guide portion and a second guide portion which are arranged away from each other in a pitch direction perpendicular to the front-rear direction. Each of the first guide portion and the second guide portion has a side portion, an upper portion and a lower portion. In each of the first guide portion and the second guide portion, the side portion intersects with the pitch direction and is provided with a first projection portion and a side surface facing inward in the pitch direction. In each of the first guide portion and the second guide portion, each of the upper portion and the lower portion intersects with an up-down direction perpendicular to both the front-rear direction and the pitch direction, and at least one of the upper portion and the lower portion is provided with a second projection portion. In each of the first guide portion and the second guide portion, the first projection portion is away from both the upper portion and the lower portion and projects inward in the pitch direction from the side surface. In each of the first guide portion and the second guide portion, the second projection portion is away from the side surface and projects inward in the up-down direction.

According to the present invention, since the first projection portions and the second projection portions are provided, a movement of the circuit board in the connector can be restricted.

Moreover, since the first projection portion is away from the upper portion and the lower portion, spaces are formed between the first projection portion and the upper portion and formed between the first projection portion and the lower portion. Similarly, since the second projection portion is away from the side surface, a space is formed between the second projection portion and the side surface. If a circuit board of a large size is inserted into the connector, the circuit board is brought into abutment with the first projection portion and the second projection portion to deform them. As a result, the deformed ones of the first projection portion and the second projection portion securely hold the circuit board while the aforementioned spaces accommodate protruding parts of the deformed ones. Thus, the deformation of the first projection portion and the second projection portion can absorb manufacturing tolerances for the circuit board so that positioning accuracy of the circuit board in the connector can be improved.

An appreciation of the objectives of the present invention and a more complete understanding of its structure may be had by studying the following description of the preferred embodiment and by referring to the accompanying drawings.

Figure 1:
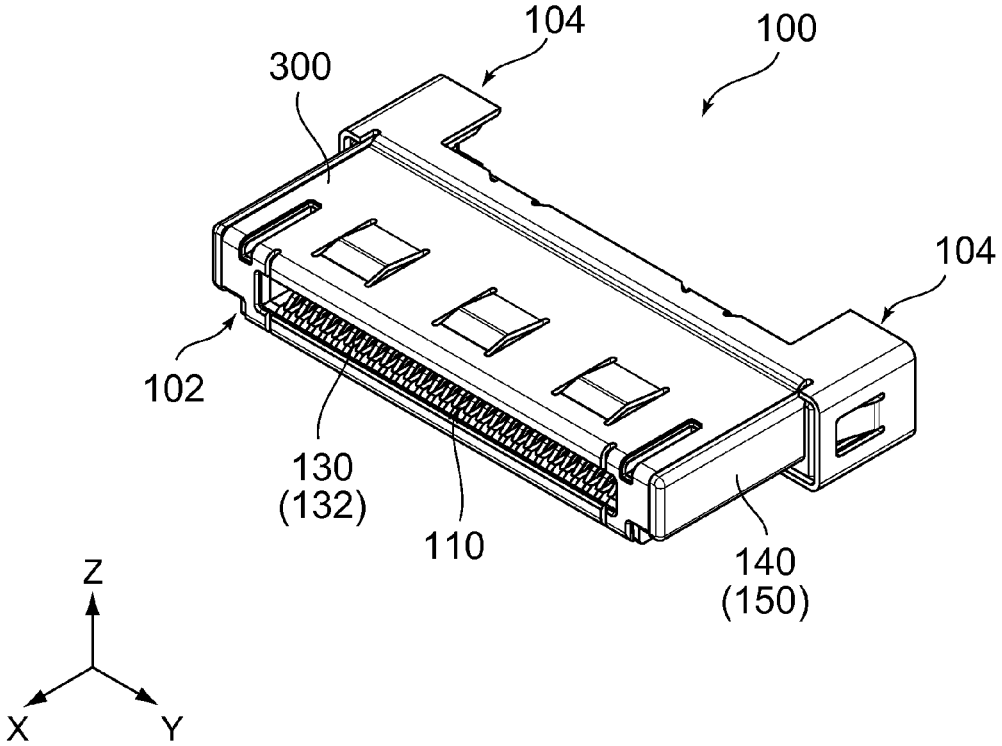
FIG. 1 is a front perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 5, a connector 100 according to an embodiment of the present invention includes a plurality of upper contacts (contacts) 120 and 120P each made of conductor, a plurality of lower contacts (contacts) 130 and 130P each made of conductor, a holding member 140 made of insulator and a shell 300 made of metal. The shell 300 partially covers the holding member 140. The holding member 140 holds the upper contacts 120 and 120P and the lower contacts 130 and 130P.

The connector 100 according to the present embodiment has a mating portion 110 which is to be mated with a mating connector (not shown). The mating portion 110 is located toward a front end 102 of the connector 100. Moreover, the connector 100 has a rear end 104 in a front-rear direction (X-direction). As can be seen from FIGS. 11 and 15, the connector 100 is connected with a circuit board 400 when the circuit board 400 is inserted into the connector 100 through the rear end 104 along the X-direction. The circuit board 400 according to the present embodiment is a relay board which is used to connect cable conductors (not shown) with the upper contacts 120 and 120P and the lower contacts 130 and 130P (see FIG. 5). The circuit board 400 according to the present embodiment is provided with a plurality of conductive pads 420 which correspond to the upper contacts 120 and 120P and the lower contacts 130 and 130P, respectively. The conductive pads 420 are formed in the vicinity of an end 410 of the circuit board 400. Moreover, the circuit board 400 has an insertion key 430 and a chamfer 440. The insertion key 430 is formed at one side of the end 410 of the circuit board 400 in the pitch direction (Y-direction) and obliquely intersects with the X-direction and the Y-direction. The chamfer 440 is formed at another side of the end 410 in the Y-direction.

Figure 5:
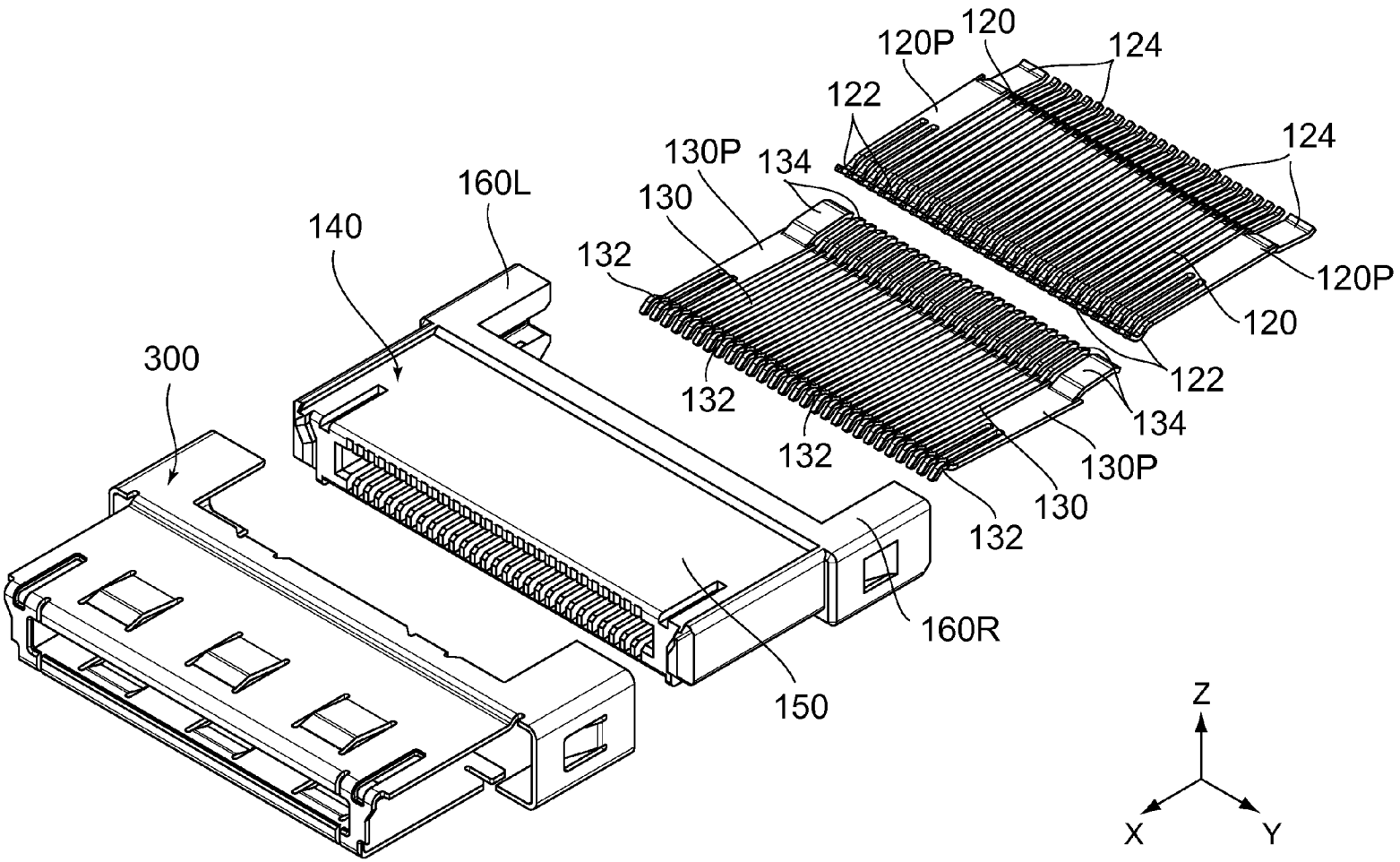
FIG. 5 is an exploded, perspective view showing the connector of FIG. 1.

As shown in FIG. 5, each of the upper contacts 120 has a front contact portion 122 and a rear contact portion (contact portion) 124. Each of the upper contacts 120P is a power contact and is wider than the upper contact 120. Each of the upper contacts 120P according to the present embodiment has three front contact portions 122 and one rear contact portion 124. The front contact portion 122 of the upper contact 120P has a size same as that of the front contact portion 122 of the upper contact 120. In contrast, the rear contact portion 124 of the upper contact 120P is wider than the rear contact portion 124 of the upper contact 120. The front contact portion 122 is a part which is to be connected to and brought into contact with a contact portion (not shown) of the mating connector (not shown), and the rear contact portion 124 is a part which is to be connected to and brought into contact with the conductive pad 420 of the circuit board 400 (see FIG. 11).

Similarly, each of the lower contacts 130 has a front contact portion 132 and a rear contact portion (contact portion) 134. Each of the lower contacts 130P is a power contact and is wider than the lower contact 130. Each of the lower contacts 130P according to the present embodiment has three front contact portions 132 and one rear contact portion 134. The front contact portion 132 of the lower contact 130P has a size same as that of the front contact portion 132 of the lower contact 130. In contrast, the rear contact portion 134 of the lower contact 130P is wider than the rear contact portion 134 of the lower contact 130. The front contact portion 132 is a part which is to be connected to and brought into contact with the contact portion (not shown) of the mating connector (not shown), and the rear contact portion 134 is a part which is to be connected to and brought into contact with the conductive pad 420 of the circuit board 400 (see FIG. 11).

Figure 6:
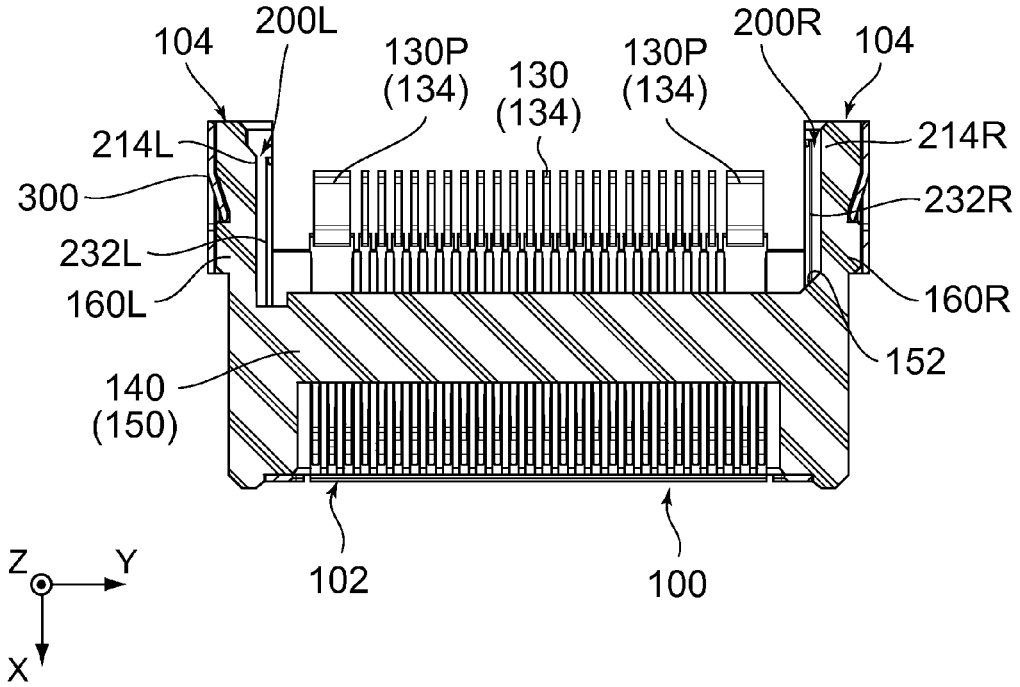
FIG. 6 is a cross-sectional view showing the connector of FIG. 4, taken along line VI-VI.

As shown in FIG. 5, the holding member 140 has a holding portion 150 and two rear arms 160R and 160L which extend in the negative X-direction (rearward) from the holding portion 150. The holding member 140 according to the present embodiment is a resin molded product. As shown in FIG. 6, the holding member 140 further has an incorrect insertion prevention portion 152. The incorrect insertion prevention portion 152 corresponds to the insertion key 430 of the circuit board 400 (see FIG. 11) and is provided in order to prevent incorrect insertion, or insertion of the circuit board 400 with incorrect attitude. In detail, the incorrect insertion prevention portion 152 has a sloping shape corresponding to that of the insertion key 430 and is located at a position corresponding to that of the insertion key 430, or located in the vicinity of a boundary between the holding portion 150 and the rear arm 160R. If the circuit board 400 is forced to be inserted with an upside down attitude, the chamfer 440 is brought into abutment with the incorrect insertion prevention portion 152 so that the circuit board 400 cannot be completely connected to the connector 100. As described above, the insertion key 430 and the incorrect insertion prevention portion 152 prevent the incorrect insertion of the circuit board 400.

Figure 2:
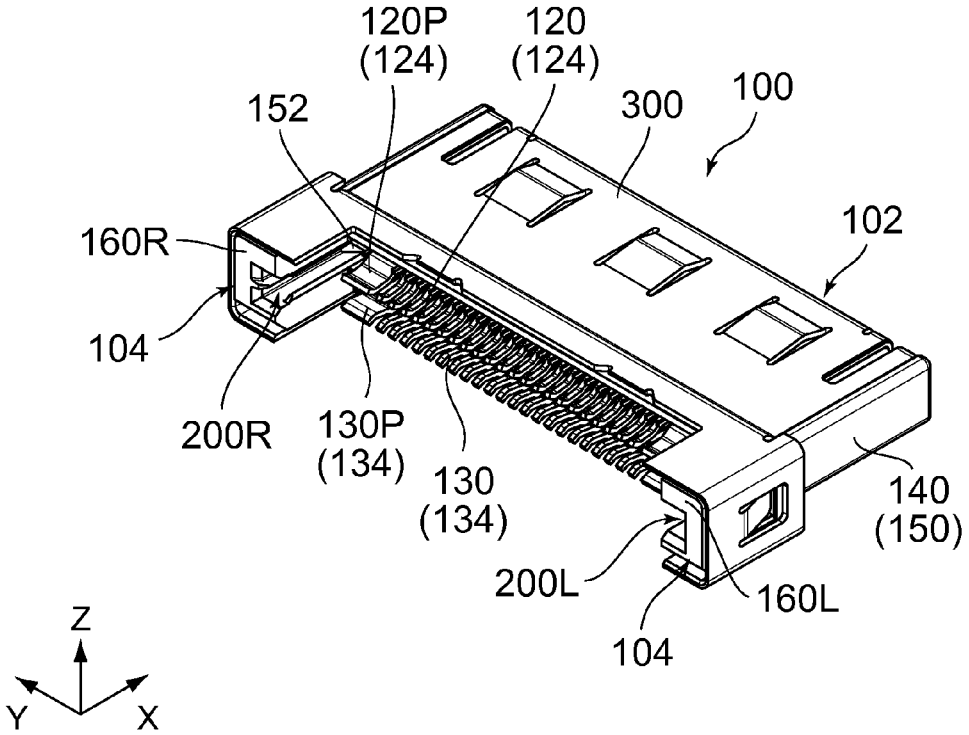
FIG. 2 is a rear perspective view showing the connector of FIG. 1.
Figure 3:
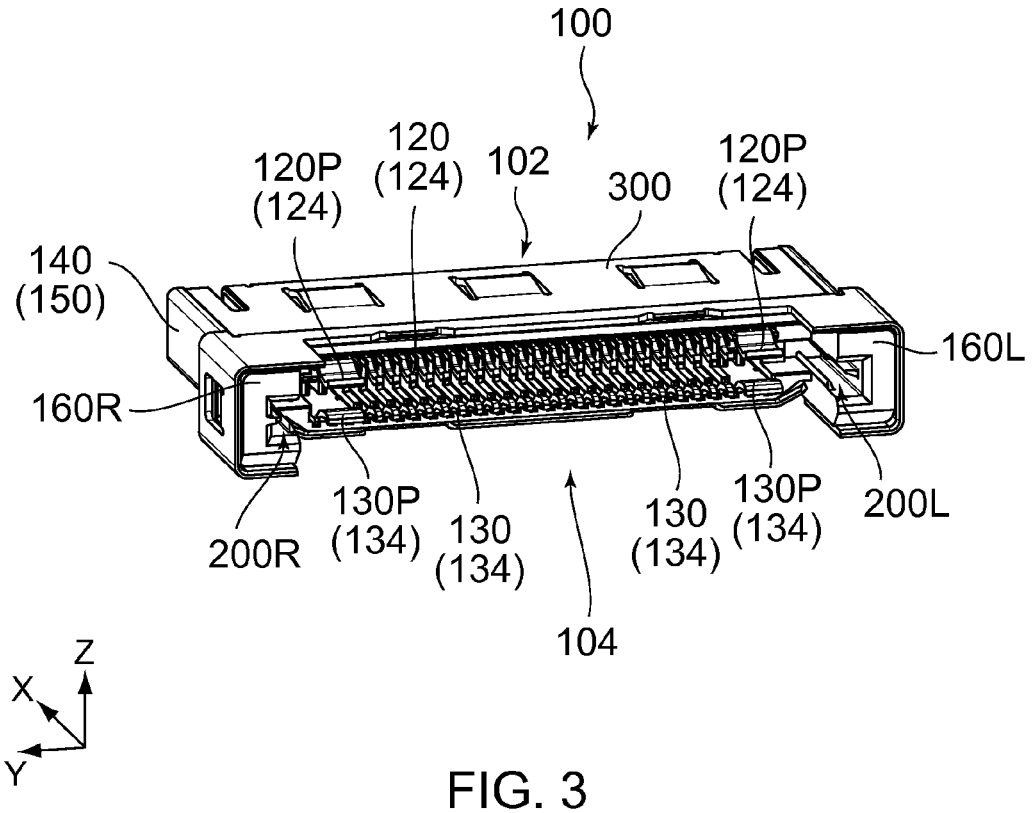
FIG. 3 is another rear perspective view showing the connector of FIG. 1.
Figure 4:
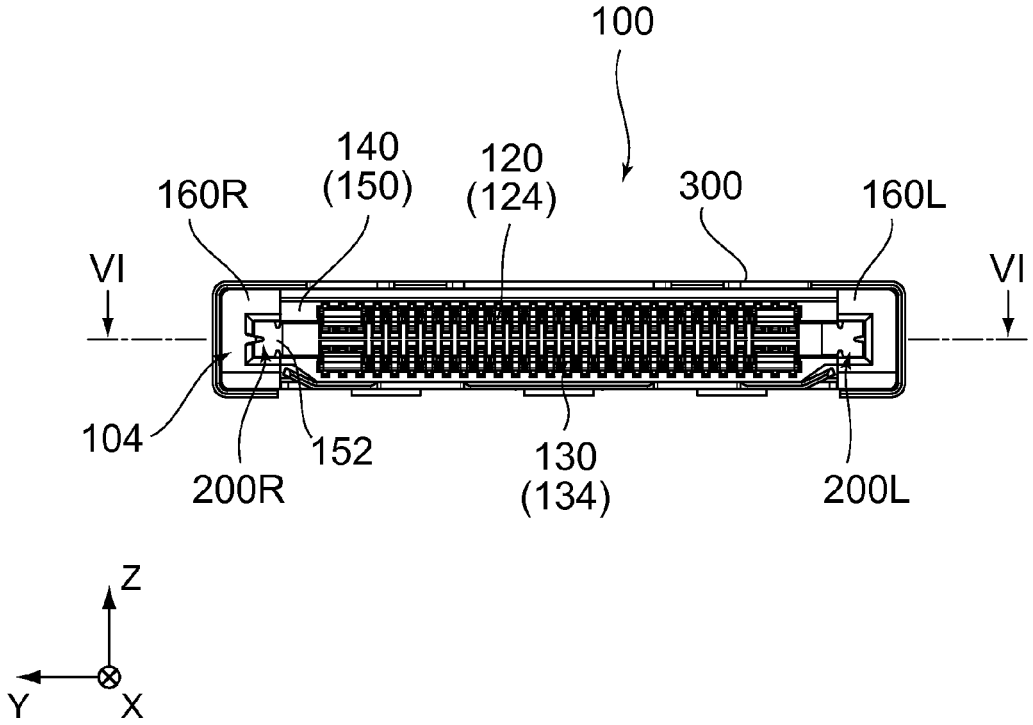
FIG. 4 is a rear view showing the connector of FIG. 1.

As can be seen from FIGS. 1 to 5, the holding portion 150 holds the upper contacts 120 and 120P and the lower contacts 130 and 130P. As shown in FIGS. 2 to 4, the upper contacts 120 are located between the two upper contacts 120P in the Y-direction, and the lower contacts 130 are located between the two lower contacts 130P in the Y-direction. The upper contacts 120 and 120P correspond to the lower contacts 130 and 130P, respectively. Moreover, the upper contacts 120 and 120P are mirror images of the lower contacts 130 and 130P. In detail, the upper contacts 120 and 120P form an upper contact set, and the lower contacts 130 and 130P form a lower contact set. A horizontal plane is defined by the X-direction and the Y-direction, wherein the horizontal plane is equally distant from the upper contact set and the lower contact set in the Z-direction. In other words, a distance between the upper contact set and the horizontal plane in the Z-direction is equal to another distance between the lower contact set and the horizontal plane in the Z-direction. The upper contacts 120 and 120P are arranged mirror symmetrically to the lower contacts 130 and 130P with respect to the horizontal plane, respectively. As can be seen from FIGS. 1 to 5, the front contact portions 122 and the front contact portions 132 are located within the mating portion 110, or more specifically, within the holding portion 150. As shown in FIGS. 2 to 4, the rear contact portions 124 and the rear contact portions 134 project rearward from the holding portion 150.

As shown in FIGS. 2 to 4, the rear arms 160R and 160L are located away from each other in the Y-direction. As can be seen from FIGS. 2 to 4 and 6, the rear contact portions 124 and the rear contact portions 134 are located between the rear arms 160R and 160L in the Y-direction.

As shown in FIGS. 2 to 4 and 6, the rear arm 160R is formed with a first guide portion 200R, and the rear arm 160L is formed with a second guide portion 200L. Accordingly, the holding member 140 has the first guide portion 200R and the second guide portion 200L which are arranged away from each other in the Y-direction. As can be seen from FIG. 6, the incorrect insertion prevention portion 152 is nearer to the first guide portion 200R than to the second guide portion 200L. In other words, a distance between the incorrect insertion prevention portion 152 and the first guide portion 200R is shorter than another distance between the incorrect insertion prevention portion 152 and the second guide portion 200L.

Figure 13:
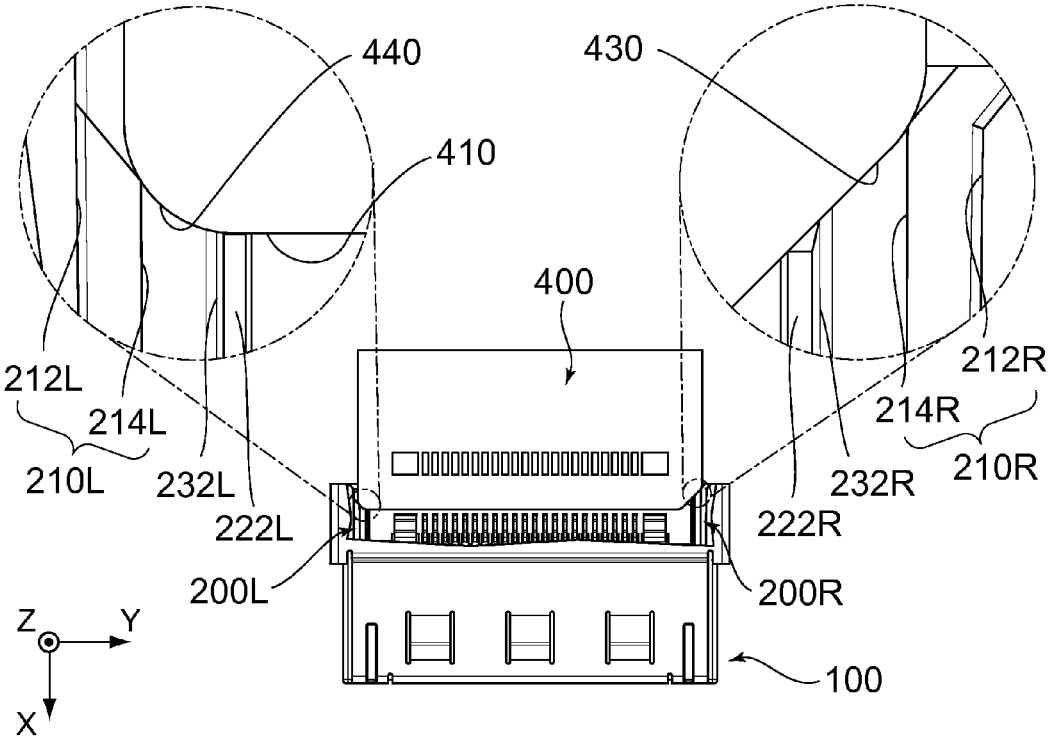
FIG. 13 is a top view showing the connector and the circuit board in a state subsequent to that of FIG. 12, wherein the connector and the circuit board are partially enlarged to be illustrated.

As can be seen from FIG. 13, the first guide portion 200R and the second guide portion 200L not only guide the insertion of the circuit board 400 into the connector 100 but also position the circuit board 400 in the connector 100 while considering manufacturing tolerances for the circuit board 400. In particular, as described later, the first guide portion 200R and the second guide portion 200L according to the present embodiment hold the circuit board 400 when the circuit board 400 has a size which is within the manufacturing tolerances but is larger than or equal to a predetermined size.

Figure 7:
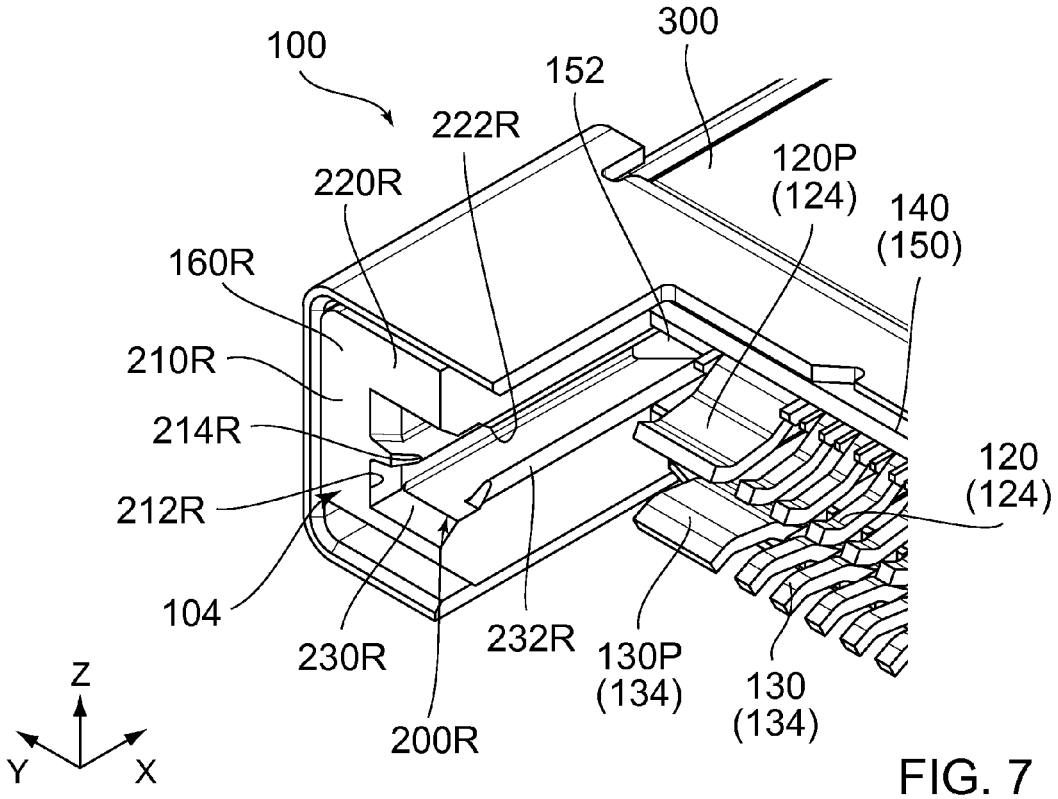
FIG. 7 is an enlarged, perspective view showing a first guide portion and its surroundings of the connector of FIG. 2.
Figure 8:
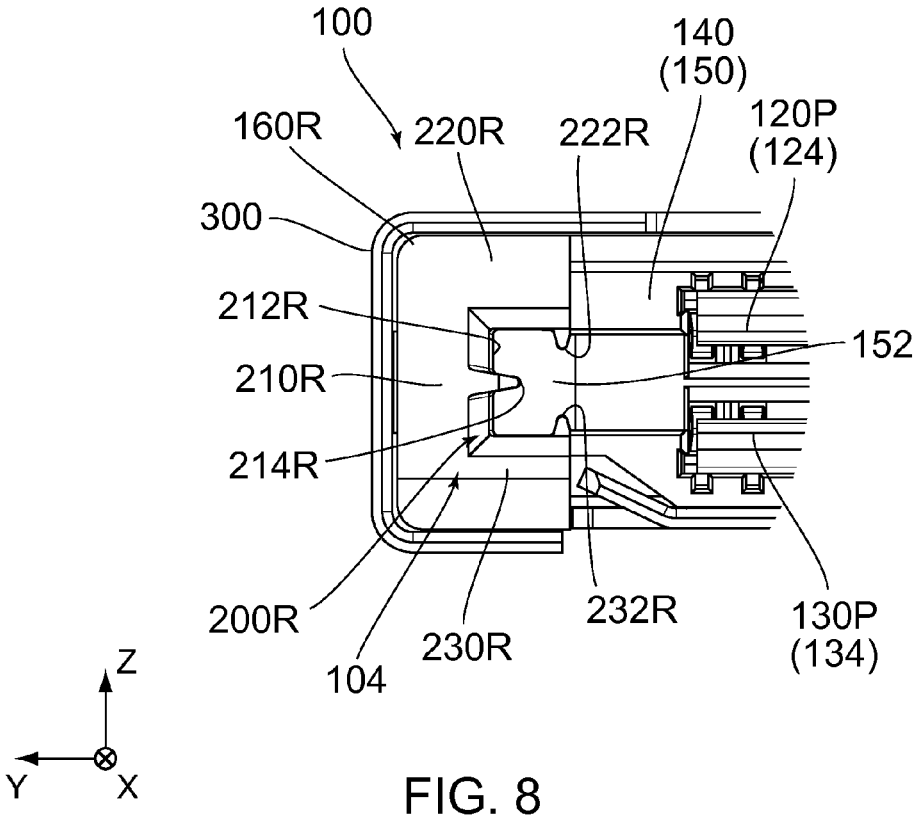
FIG. 8 is an enlarged, rear view showing the first guide portion and its surroundings of the connector of FIG. 4.

As shown in FIGS. 7 and 8, the first guide portion 200R has a side portion 210R, an upper portion 220R and a lower portion 230R which roughly form an angular C-like shape in a perpendicular plane perpendicular to the front-rear direction, or in the YZ-plane. More specifically, the upper portion 220R and the lower portion 230R protrude inward in the Y-direction from opposite ends of the side portion 21 OR in the Z-direction (upper-lower direction), respectively, and face each other in the Z-direction. In detail, in the first guide portion 200R, the side portion 210R, the upper portion 220R and the lower portion 230R are formed as described below. The side portion 21 OR intersects with the Y-direction and is provided with a first projection portion (projection portion) 214R and a side surface 212R facing inward in the Y-direction. The projection portion 214R is located away from both the upper portion 220R and the lower portion 230R and projects inward in the Y-direction from the side surface 212R. The thus-formed projection portion 214R and the upper portion 220R has a gap or a space formed therebetween, and the projection portion 214R and the lower portion 230R has another gap or another space formed therebetween. Each of the upper portion 220R and the lower portion 230R intersects with the Z-direction. The upper portion 220R is provided with a second projection portion (projection portion) 222R. The projection portion 222R is located away from the side surface 212R and projects downward, or in the negative Z-direction. In other words, the projection portion 222R projects inward in the Z-direction. The thus-formed projection portion 222R and the side surface 212R has a gap or a space formed therebetween. Similarly, the lower portion 230R is provided with a second projection portion (projection portion) 232R. The projection portion 232R is located away from the side surface 212R and projects upward, or in the positive Z-direction. In other words, the projection portion 232R projects inward in the Z-direction. The thus-formed projection portion 232R and the side surface 212R has a gap or a space formed therebetween.

Figure 9:
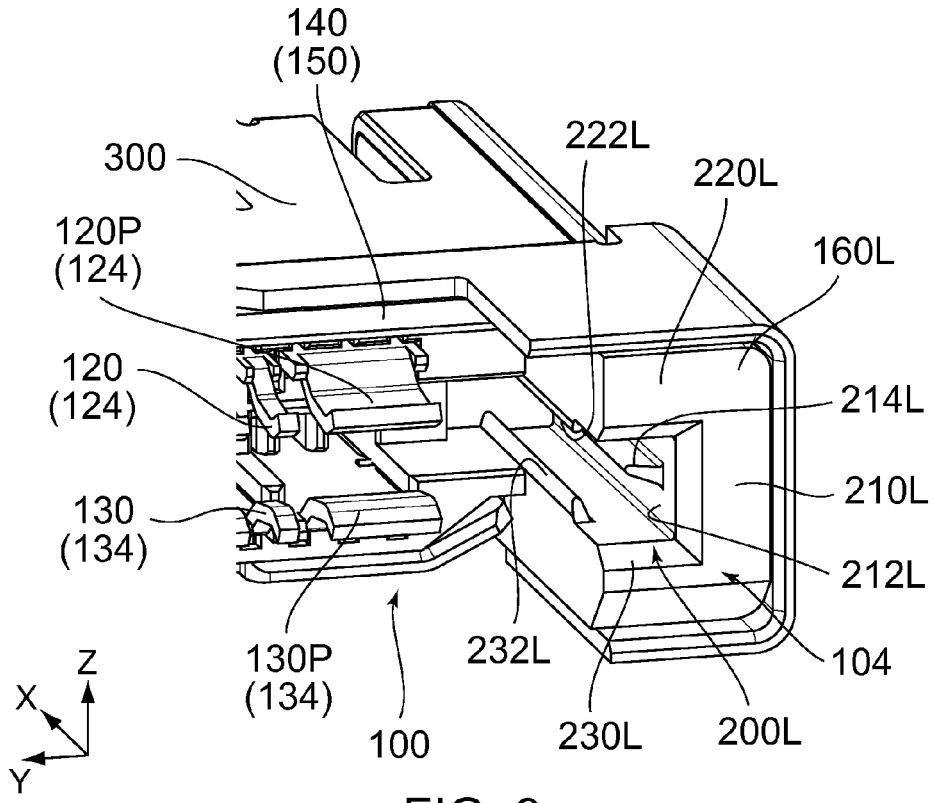
FIG. 9 is an enlarged, perspective view showing a second guide portion and its surroundings of the connector of FIG. 3.
Figure 10:
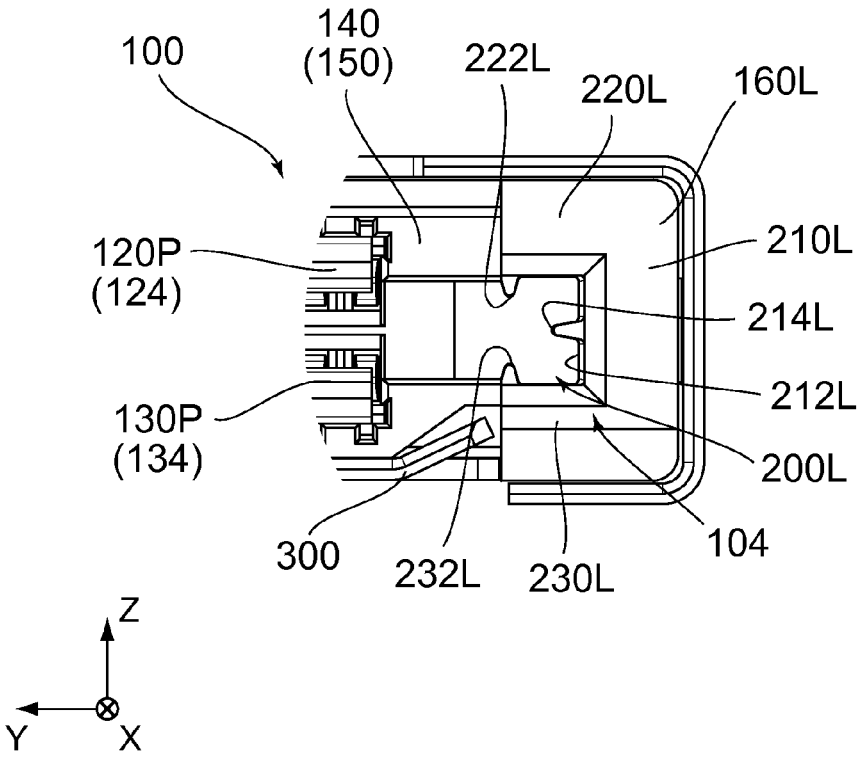
FIG. 10 is an enlarged, rear view showing the second guide portion and its surroundings of the connector of FIG. 4.

As shown in FIGS. 9 and 10, the second guide portion 200L has a side portion 210L, an upper portion 220L and a lower portion 230L which roughly form an angular C-like shape in the YZ-plane. More specifically, the upper portion 220L and the lower portion 230L protrude inward in the Y-direction from opposite ends of the side portion 210L in the Z-direction, respectively, and face each other in the Z-direction. In detail, in the second guide portion 200L, the side portion 210L, the upper portion 220L and the lower portion 230L are formed as described below similar to those in the first guide portion 200R. The side portion 210L intersects with the Y-direction and is provided with a first projection portion (projection portion) 214L and a side surface 212L facing inward in the Y-direction. The projection portion 214L is away from both the upper portion 220L and the lower portion 230L and projects inward in the Y-direction from the side surface 212L. The thus-formed projection portion 214L and the upper portion 220L has a gap or a space formed therebetween, and the projection portion 214L and the lower portion 230L has another gap or another space formed therebetween. Each of the upper portion 220L and the lower portion 230L intersects with the Z-direction. The upper portion 220L is provided with a second projection portion (projection portion) 222L. The projection portion 222L is located away from the side surface 212L and projects in the negative Z-direction. The thus-formed projection portion 222L and the side surface 212L has a gap or a space formed therebetween. Similarly, the lower portion 230L is provided with a second projection portion (projection portion) 232L. The projection portion 232L is located away from the side surface 212L and projects in the positive Z-direction. The thus-formed projection portion 232L and the side surface 212L has a gap or a space formed therebetween.

The holding member 140 according to the present embodiment is formed by using two metal molds which are dividable into front and rear. Accordingly, each of the projection portions 214R, 222R, 232R, 214L, 222L and 232L extends long in the front-rear direction, or in the X-direction. However, the present invention is not limited thereto. For example, each of the projection portions 214R, 222R, 232R, 214L, 222L and 232L may be formed of a plurality of projections arranged in the X-direction or may extend shorter in the X-direction.

As shown in FIGS. 8 and 10, each of the projection portions 214R and 214L is thin. In detail, as shown in FIG. 8, in the first guide portion 200R, a thickness, or a size in the Z-direction, of the projection portion 214R is not more than one third of another size of the side surface 212R in the Z-direction. As shown in FIG. 10, in the second guide portion 200L, a thickness, or a size in the Z-direction, of the projection portion 214L is not more than one third of another size of the side surface 212L in the Z-direction. Moreover, as shown in FIG. 8, a thickness, or a size in the Y-direction, of each of the projection portions 222R and 232R is nearly equal to the thickness of the projection portion 214R. As shown in FIG.

10, a thickness, or a size in the Y-direction, of each of the projection portions 222L and 232L is nearly equal to the thickness of the projection portion 214L. In other words, as shown in FIGS. 8 and 10, each of the projection portions 222R, 222L, 232R and 232L is also thin. Moreover, each of the projection portions 214R, 214L, 222R, 222L, 232R and 232L according to the present embodiment has a tapered shape in the perpendicular plane, or in the YZ-plane.

Referring to FIG. 13, since the projection portions 214R, 214L, 222R, 222L, 232R and 232L are provided, a position of the circuit board 400 in the connector 100 is limited as compared with a case where the projection portions 214R, 214L, 222R, 222L, 232R and 232L are not provided. In other words, the connector 100 according to the present embodiment can restrict a movement of the circuit board 400 in the connector 100 to improve positioning accuracy of a circuit board 400 in the connector 100. In detail, if the size of the circuit board 400 is large within the manufacturing tolerances in the case where the projection portions 214R, 214L, 222R, 222L, 232R and 232L are not provided, the circuit board 400 might be intensively pressed against inner surfaces of the first guide portion 200R and the second guide portion 200L so that the circuit board 400 might not to be inserted into the connector 100. However, as previously described, each of the projection portions 214R, 214L, 222R, 222L, 232R and 232L according to the present embodiment has the gap or the space formed therearound. When the size of the circuit board 400 is large, the projection portions 214R, 214L, 222R, 222L, 232R and 232L are deformed to be partially moved into the gaps or the spaces. Accordingly, even if the size of the circuit board 400 is large within the manufacturing tolerances, the circuit board 400 can be inserted into the connector 100. Moreover, after the circuit board 400 is inserted in the connector 100 under a condition where the projection portions 214R, 214L, 222R, 222L, 232R and 232L are deformed, the connector 100 is held by the projection portions 214R, 214L, 222R, 222L, 232R and 232L. Accordingly, the circuit board 400 can be more securely positioned in the connector 100.

In particular, as described above, the thickness of each of the projection portions 214R, 214L, 222R, 222L, 232R and 232L is not more than one third of the size of each of the side surfaces 212R and 212L in the Z-direction. Every one of the projection portions 214R, 214L, 222R, 222L, 232R and 232L is thin to be relatively easily deformed even when the size of the circuit board 400 is large. Accordingly, even when the circuit board 400 has a large size, the circuit board 400 can be relatively easily inserted into the connector 100 while being positioned by the projection portions 214R, 214L, 222R, 222L, 232R and 232L.

Moreover, every one of the projection portions 214R, 214L, 222R, 222L, 232R and 232L according to the present embodiment has the tapered shape in the YZ-plane. Accordingly, even when the circuit board 400 has a large size, the projection portions 214R, 214L, 222R, 222L, 232R and 232L can be deformed just as much as necessary so as to receive the circuit board 400.

In the present embodiment, a distance between the side surface 212R and the side surface 212L is designed in consideration of the maximum size SA within the manufacturing tolerances for the circuit board 400. More specifically, the distance between the side surface 212R and the side surface 212L is designed to be not less than the maximum size SA. Accordingly, even if the size of the circuit board 400 is varied within the manufacturing tolerances, the circuit board 400 can be inserted into the connector 100. Moreover, a distance between the projection portion 214R and the projection portion 214L is designed in consideration of the minimum size SI within the manufacturing tolerances for the circuit board 400. More specifically, the distance between the projection portion 214R and the projection portion 214L is designed to be not less the minimum size SI. For example, when the distance between the projection portion 214R and the projection portion 214L is equal to the minimum size SI, the projection portion 214R and the projection portion 214L are deformed by the insertion of the circuit board 400 into the connector 100 so that the circuit board 400 is sandwiched between and held by the deformed projection portion 214R and the projection portion 214L. Moreover, even when the distance between the projection portion 214R and the projection portion 214L is equal to the standard value, or the nominal size, within the manufacturing tolerances for the circuit board 400, the connector 100 can properly hold the circuit board 400 as described below. For example, when the actual size of the circuit board 400 is smaller than the standard value, the projection portion 214R and the projection portion 214L properly position the circuit board 400 without being deformed upon the insertion of the circuit board 400 into the connector 100. On the other hand, when the actual size of the circuit board 400 is not less than the standard value, the projection portion 214R and the projection portion 214L are deformed by the insertion of the circuit board 400 into the connector 100 so that the circuit board 400 is sandwiched between and held by the deformed projection portion 214R and the projection portion 214L.

Referring to FIGS. 2, 7 and 9, a vertical plane, or a plane perpendicular to the Y-direction, is defined by the X-direction and the Z-direction, wherein the vertical plane is equally distant from the projection portion 214R and the projection portion 214L in the Y-direction. In other words, a distance between the projection portion 214R and the vertical plane in the Y-direction is equal to another distance between the projection portion 214L and the vertical plane in the Y-direction. As can be seen from comparison between FIGS. 7 and 9, the first guide portion 200R and the second guide portion 200L according to the present embodiment have structures asymmetrical to each other in the Y-direction with respect to this vertical plane. More specifically, the projection portion 214R and the projection portion 214L are arranged asymmetrically with each other with respect to the vertical plane. Moreover, the projection portion 222R and the projection portion 222L are arranged asymmetrically with each other with respect to the vertical plane. Similarly, the projection portion 232R and the projection portion 232L are arranged asymmetrically with each other with respect to the vertical plane.

In detail, a distance between the projection portion 214R and the rear end 104 of the connector 100 is different from another distance between the projection portion 214L and the rear end 104. A distance between the projection portion 222R and the rear end 104 is also different from another distance between the projection portion 222L and the rear end 104. A distance between the projection portion 232R and the rear end 104 is also different from another distance between the projection portion 232L and the rear end 104. These structures correspond to the asymmetricity of the shape of the end 410 of the circuit board 400 (see FIG. 11).

Figure 11:
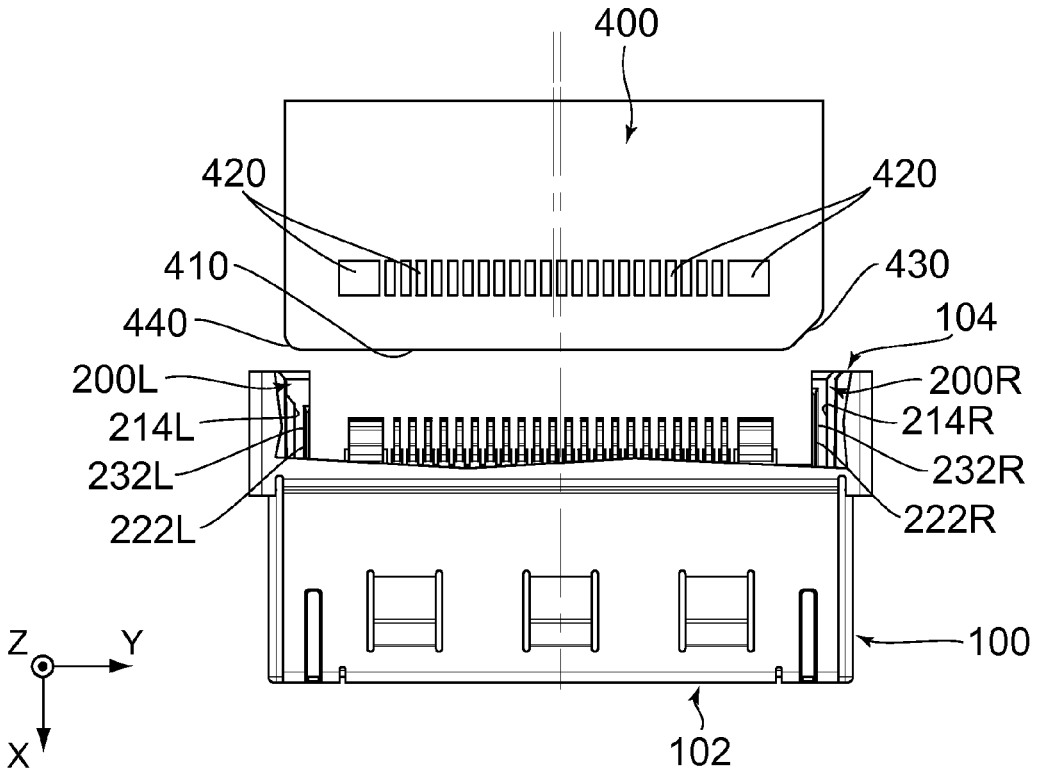
FIG. 11 is a top view showing the connector of FIG. 1 together with a circuit board, wherein the connector is partially cut, and the connector and the circuit board are in a state where the circuit board begins to be inserted into the connector while being shifted toward the second guide portion.

In particular, in the present embodiment, as shown in FIG. 11, the projection portions 214R, 222R and 232R of the first guide portion 200R are arranged in correspondence with the shape of the insertion key 430 of the circuit board 400, while the projection portions 214L, 222L and 232L of the second guide portion 200L are arranged in correspondence with the shape of the chamfer 440. Accordingly, the projection portions 214L, 222L and 232L are further away from the rear end 104 of the connector 100 in comparison with the projection portions 214R, 222R and 232R, respectively. In other words, the projection portion 214R and the projection portion 214L are differently distant from the rear end 104. In particular, the distance between the projection portion 214R and the rear end 104 is shorter than the distance between the projection portion 214L and the rear end 104. Similarly, the projection portion 222R and the projection portion 222L are differently distant from the rear end 104, and the projection portion 232R and the projection portion 232L are differently distant from the rear end 104. However, the aforementioned structures can be modified depending on the shape of the end 410 of the circuit board 400. For example, the distance between the projection portion 214R and the rear end 104 may be equal to the distance between the projection portion 214L and the rear end 104. The distance between the projection portion 222R and the rear end 104 also may be equal to the distance between the projection portion 222L and the rear end 104. The distance between the projection portion 232R and the rear end 104 also may be equal to the distance between the projection portion 232L and the rear end 104.

As described above, the projection portions 214R, 214L, 222R, 222L, 232R and 232L according to the present embodiment have asymmetricity which corresponds to the shape of the circuit board 400. Accordingly, even if a relative position of the circuit board 400 to the connector 100 is shifted in the Y-direction upon the insertion of the circuit board 400, the relative position of the circuit board 400 can be corrected.

Figure 12:
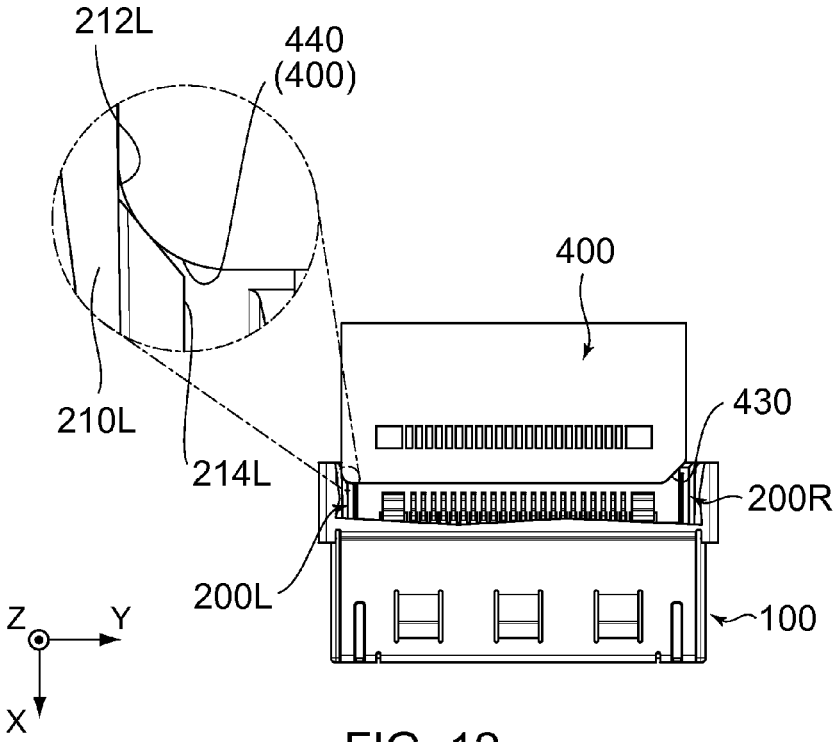
FIG. 12 is a top view showing the connector and the circuit board in a state subsequent to that of FIG. 11, wherein the connector and the circuit board are partially enlarged to be illustrated.
Figure 14:
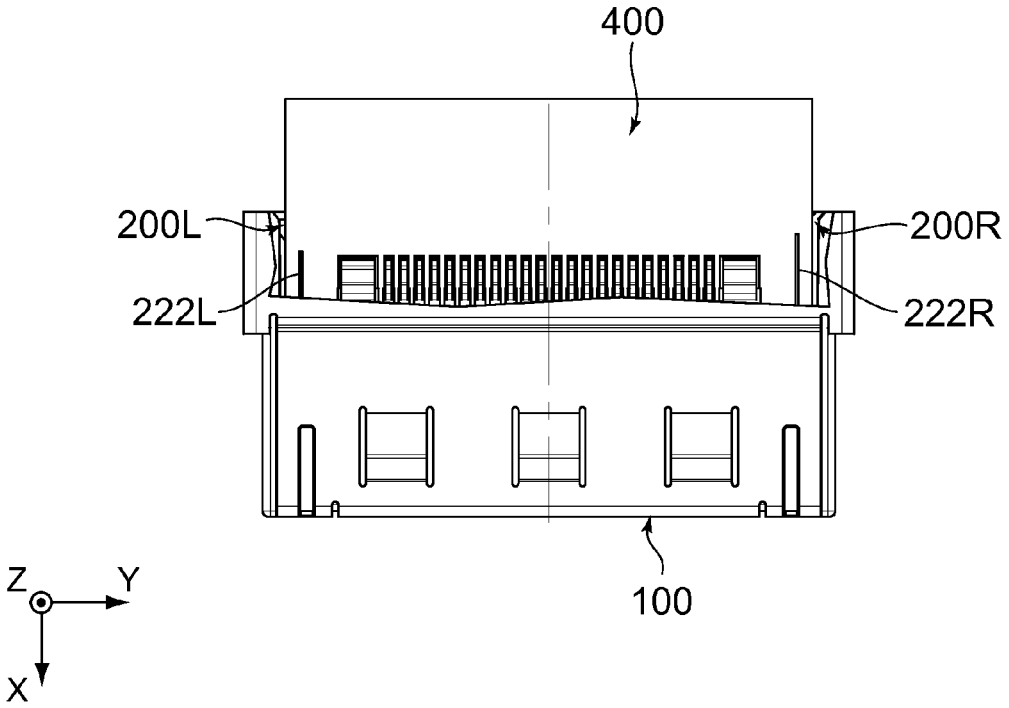
FIG. 14 is a top view showing the connector of FIG. 1 and the circuit board, wherein the connector is partially cut, and the connector and the circuit board are in a state where the circuit board is inserted in the connector.

For example, the circuit board 400 shown in FIG. 11 begins to be inserted into the connector 100 while being shifted toward the second guide portion 200L. In this case, as shown in FIG. 12, the chamfer 440 is brought into abutment with the projection portion 214L of the second guide portion 200L so that the circuit board 400 is forced to be moved in the positive Y-direction. At that time, the chamfer 440 is not yet brought into contact with the projection portions 222L and 232L which are located at upper and lower sides of the second guide portion 200L, respectively. Accordingly, the chamfer 440 can be moved in the positive X-direction without specific difficulty even in comparison with the insertion key 430. In other words, a force for the insertion of the circuit board 400 does not lose balance. Accordingly, the circuit board 400 can be prevented from pivoting about the chamfer 440 in the XY-plane. The circuit board 400 is therefore moved in the positive X-direction while being properly moved in the positive Y-direction. In other words, the circuit board 400 is properly moved in a translational motion. Subsequently, as shown in FIG. 13, when the chamfer 440 begins to be brought into contact with the upper and lower projection portions 222L and 232L, the insertion key 430 is brought into contact with the projection portions 214R, 222R and 232R of the first guide portion 200R. In other words, when the chamfer 440 begins to be brought into contact with the upper and lower projection portions 222L and 232L, the positional shift between the circuit board 400 and the connector 100 is corrected. Accordingly, as shown in FIG. 14, the circuit board 400 can be properly connected to the connector 100 under a condition where the positional shift is corrected.

Figure 15:
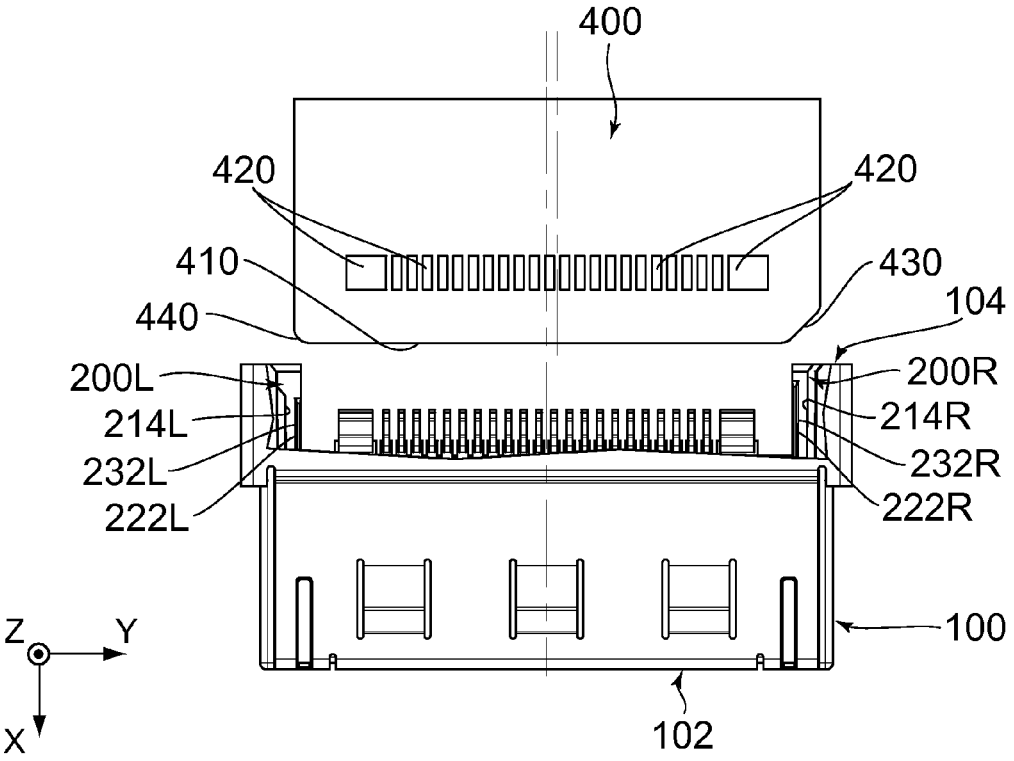
FIG. 15 is a top view showing the connector of FIG. 1 together with the circuit board, wherein the connector is partially cut, and the connector and the circuit board are in a state where the circuit board begins to be inserted into the connector while being shifted toward the first guide portion.
Figure 16:
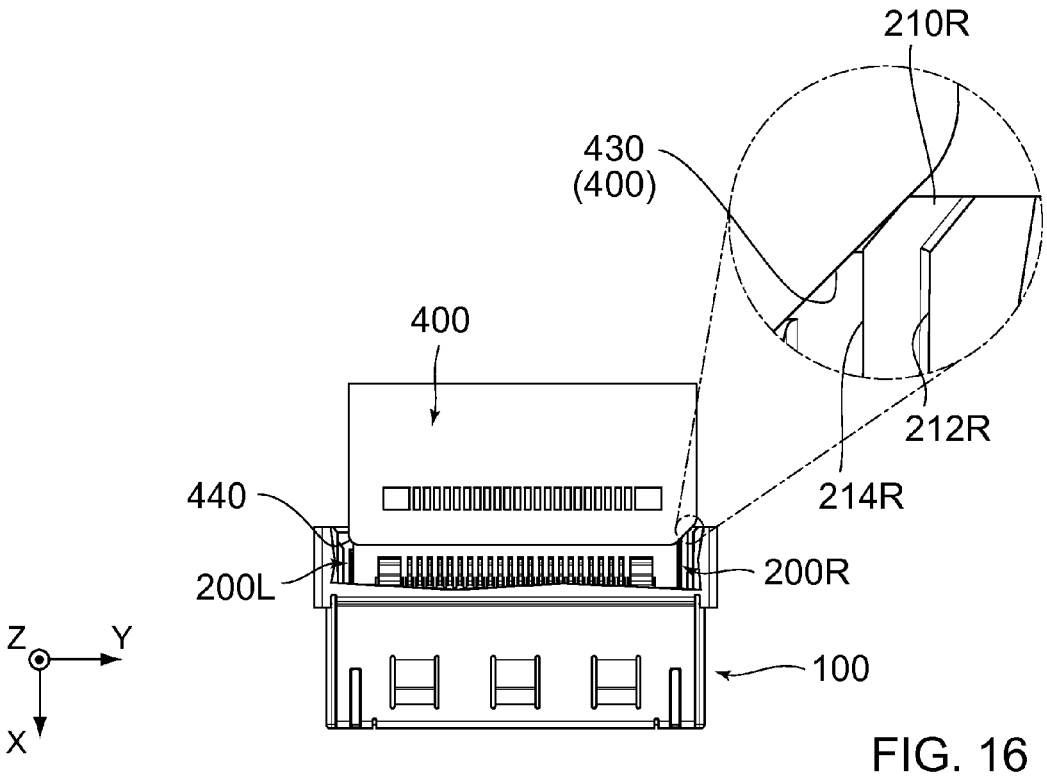
FIG. 16 is a top view showing the connector and the circuit board in a state subsequent to that of FIG. 15, wherein the connector and the circuit board are partially enlarged to be illustrated.
Figure 17:
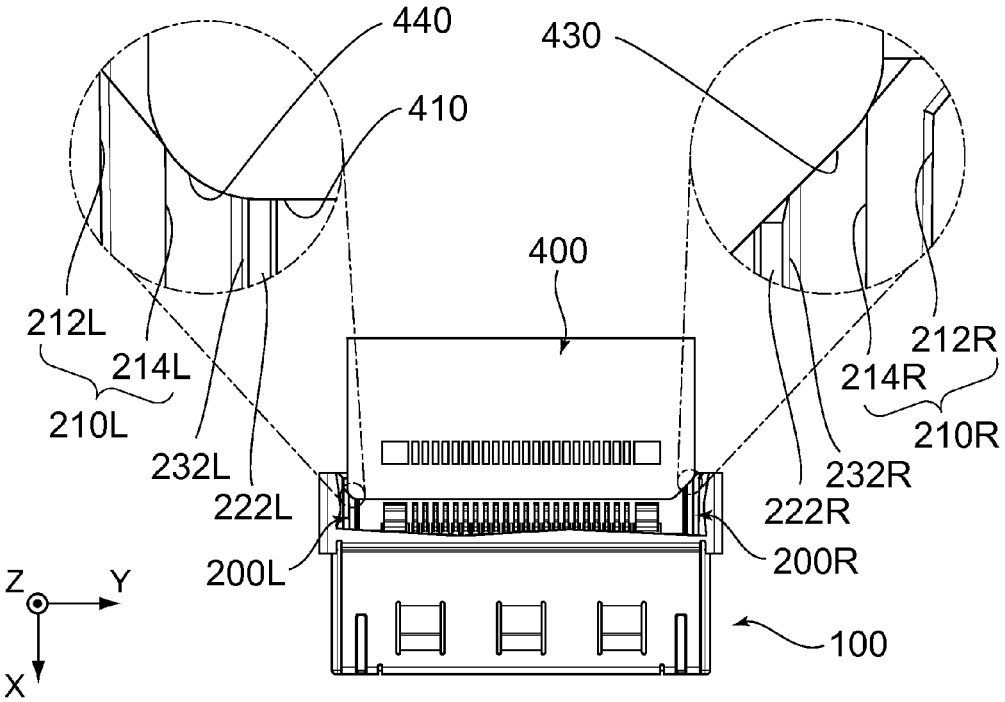
FIG. 17 is a top view showing the connector and the circuit board in a state subsequent to that of FIG. 16, wherein the connector and the circuit board are partially enlarged to be illustrated.
Figure 18:
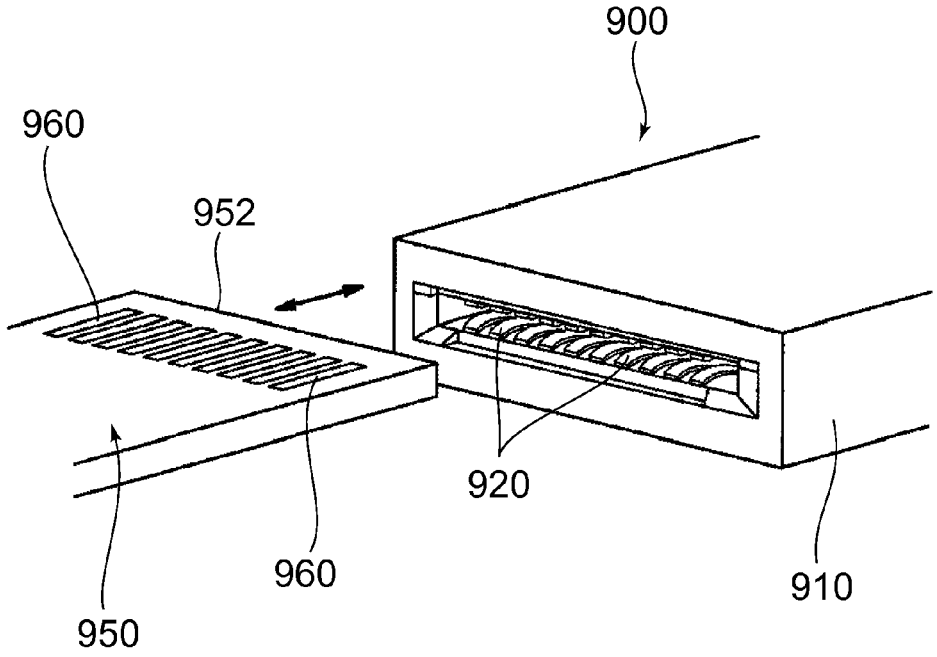
FIG. 18 PRIOR ART
FIG. 18 is a perspective view showing a connector of Patent Document 1.
Figure 19:
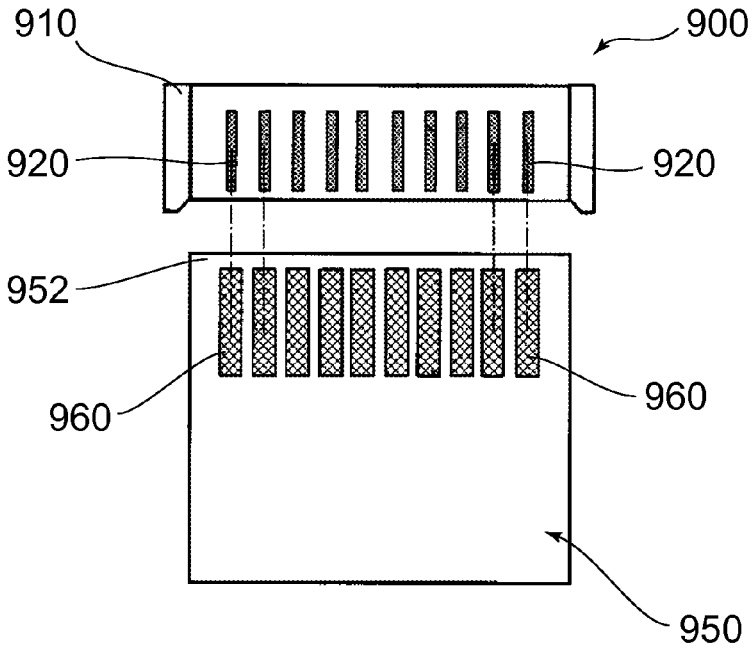
FIG. 19 PRIOR ART
FIG. 19 is a schematic view showing an arrangement of contacts and conductive pads of Patent Document 1.

For another example, the circuit board 400 shown in FIG. 15 begins to be inserted into the connector 100 while being shifted toward the first guide portion 200R. In this case, as shown in FIG. 16, the insertion key 430 is brought into abutment with the projection portion 214R of the first guide portion 200R so that the circuit board 400 is forced to be moved in the negative Y-direction. At that time, the insertion key 430 is not yet brought into contact with the projection portions 222R and 232R which are located at upper and lower sides of the first guide portion 200R, respectively. Accordingly, the insertion key 430 can be moved in the positive X-direction without specific difficulty even in comparison with the chamfer 440. In other words, the circuit board 400 can be prevented from pivoting about the insertion key 430 in the XY-plane. The circuit board 400 is therefore moved in the positive X-direction while being properly moved in the negative Y-direction. In other words, the circuit board 400 is properly moved in a translational motion. Subsequently, as shown in FIG. 17, when the insertion key 430 begins to be brought into contact with the upper and lower projection portions 222R and 232R, the chamfer 440 is brought into contact with the projection portions 214L, 222L and 232L of the second guide portion 200L. In other words, when the insertion key 430 begins to be brought into contact with the upper and lower projection portions 222R and 232R, the positional shift between the circuit board 400 and the connector 100 is corrected. Accordingly, as shown in FIG. 14, the circuit board 400 can be properly connected to the connector 100 under the condition where the positional shift is corrected.

As can be seen from FIG. 6, in the present embodiment, the negative X-side end (rear end) of each of the projection portions 214R and 214L is located rearward, or toward the negative X-side, of the rear contact portions 124 and 134. Moreover, a rear end of each of the projection portions 222R, 222L, 232R and 232L is located rearward of the rear contact portions 124 and 134. Accordingly, even when the relative position of the circuit board 400 to the connector 100 is shifted in the Y-direction, the circuit board 400 is connected to the connector 100 after the relative position is corrected as described above. In the present embodiment, the circuit board 400 is inserted between the rear contact portions 124 and the rear contact portions 134 (see FIGS. 7 and 9) after the position adjustment. In other words, the circuit board 400 does not receive contact forces from the rear contact portions 124 and 134 until the adjustment of the relative position. The connector 100 according to the present embodiment is designed not to apply unnecessary stress to the circuit board 400.

Although the explanation is already made about the present invention while referring to the specific structure, the present invention is not limited thereto.

For example, in the aforementioned embodiment, the connector 100 includes the projection portions 222R and 222L (second projection portions) projecting from the upper portions 220R and 220L (upper portions) and the projection portions 232R and 232L (second projection portions) projecting from the lower portions 230R and 230L (lower portions). In other words, the second projection portions project from the upper portion and the lower portion, respectively. However, the second projection portion may project only from one of the upper portion and the lower portion. In other words, it is sufficient that at least one of the upper portion and the lower portion is provided with the second projection portion.

In the aforementioned embodiment, rear ends of the rear arms 160R and 160L constitute the rear end 104 of the connector 100. However, the present invention is not limited thereto. The rear end 104 may be any part of the connector 100, provided that the part can be used as a reference part in the explanation about the asymmetricity under the case where the first guide portion 200R and the second guide portion 200L have the structures asymmetrical to each other. For example, if the rear arm 160R and the rear arm 160L have lengths different from each other, one of the rear ends which projects further than a remaining one of the rear ends may be the rear end 104. If the connector 100 includes a part which is located rearward of the rear arm 160R and the rear arm 160L, this part may be the rear end 104.

The present application is based on a Japanese patent application of JP2014-013569 filed before the Japan Patent Office on Jan. 28, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which has a rear end in a front-rear direction and is connected with a circuit board when the circuit board is inserted into the connector through the rear end along the front-rear direction, wherein:

the connector comprises a plurality of contacts and a holding member holding the contacts;

the holding member has a first guide portion and a second guide portion which are arranged away from each other in a pitch direction perpendicular to the front-rear direction;

each of the first guide portion and the second guide portion has a side portion, an upper portion and a lower portion;

in each of the first guide portion and the second guide portion, the side portion intersects with the pitch direction and is provided with a first projection portion and a side surface facing inward in the pitch direction;

in each of the first guide portion and the second guide portion, each of the upper portion and the lower portion intersects with an up-down direction perpendicular to both the front-rear direction and the pitch direction, and at least one of the upper portion and the lower portion is provided with a second projection portion;

in each of the first guide portion and the second guide portion, the first projection portion is away from both the upper portion and the lower portion and projects inward in the pitch direction from the side surface; and in each of the first guide portion and the second guide portion, the second projection portion is away from the side surface and projects inward in the up-down direction.

2. The connector as recited in claim 1, wherein:

the connector has a mating portion which is to be mated with a mating connector; and the mating portion is located toward a front end of the connector.

3. The connector as recited in claim 1, wherein, in each of the first guide portion and the second guide portion, each of the upper portion and the lower portion is provided with the second projection portion.

4. The connector as recited in claim 1, wherein, each of the first projection portions and the second projection portions extends long in the front-rear direction.

5. The connector as recited in claim 1, wherein:

a vertical plane is defined by the front-rear direction and the up-down direction;

the vertical plane is equally distant from the first projection portion of the first guide portion and the first projection portion of the second guide portion in the pitch direction; and the first projection portion of the first guide portion and the first projection portion of the second guide portion are arranged asymmetrically with each other with respect to the vertical plane, or the second projection portion of the first guide portion and the second projection portion of the second guide portion are arranged asymmetrically with each other with respect to the vertical plane.

6. The connector as recited in claim 5, wherein the first projection portion of the first guide portion and the first projection portion of the second guide portion are differently distant from the rear end of the connector, or the second projection portion of the first guide portion and the second projection portion of the second guide portion are differently distant from the rear end of the connector.

7. The connector as recited in claim 6, wherein:

the circuit board has an insertion key which is formed at one end of the circuit board in the pitch direction and which obliquely intersects with the front-rear direction and the pitch direction;

the holding member has an incorrect insertion prevention portion which corresponds to the insertion key and which is provided in order to prevent insertion of the circuit board with incorrect attitude;

the incorrect insertion prevention portion is nearer to the first guide portion than to the second guide portion; and a distance between the first projection portion of the first guide portion and the rear end of the connector is shorter than another distance between the first projection portion of the second guide portion and the rear end of the connector.

8. The connector as recited in claim 1, wherein, in each of the first guide portion and the second guide portion, a size of the first projection portion in the up-down direction is not more than one third of another size of the side surface in the up-down direction.

9. The connector as recited in claim 8, wherein:

each of the first projection portions has a tapered shape in a perpendicular plane perpendicular to the front-rear direction; and each of the second projection portions has a tapered shape in the perpendicular plane.

10. The connector as recited in claim 1, wherein:

the circuit board is provided with a plurality of conductive pads which correspond to the contacts, respectively;

each of the contacts has a contact portion which is to be in contact with the conductive pad of the circuit board;

an end of each of the first projection portions is located rearward of the contact portions; and an end of each of the second projection portions is located rearward of the contact portions.

* * * * *